US007265723B1

(12) United States Patent
Chan et al.

(10) Patent No.: US 7,265,723 B1
(45) Date of Patent: Sep. 4, 2007

(54) ANTENNA DEVICE HAVING PIVOTAL DEVICE

(75) Inventors: Yat To Chan, Taipei Hsien (TW); Justine Yen, Taipei Hsien (TW)

(73) Assignee: Airwise Technology Co., Ltd., Hsinjuan Taipei, Hsien (TW)

( * ) Notice: Subject to any disclaimer, the term of this patent is extended or adjusted under 35 U.S.C. 154(b) by 43 days.

(21) Appl. No.: 11/338,938

(22) Filed: Jan. 25, 2006

(51) Int. Cl.
*H01Q 1/24* (2006.01)

(52) U.S. Cl. ..... 343/702

(58) Field of Classification Search ..... 343/702, 343/878, 880, 882
See application file for complete search history.

(56) References Cited

U.S. PATENT DOCUMENTS 5,714,958 A * 2/1998 Rudisill ..... 343/702
6,023,218 A 2/2000 Tremblay ..... 340/425.5
6,023,245 A 2/2000 Gomez et al. ..... 343/725
6,337,671 B1 * 1/2002 Lee ..... 343/901
6,353,733 B1 * 3/2002 Murray et al. ..... 455/90.1
7,030,818 B2 * 4/2006 Rogalski et al. ..... 343/702
7,076,281 B2 * 7/2006 Kim ..... 455/575.7

* cited by examiner

*Primary Examiner*—Hoanganh Le
(74) *Attorney, Agent, or Firm*—Charles E. Baxley

(57) ABSTRACT

An antenna device includes a housing having a peripheral depression located around an orifice and formed between a peripheral rib and an inner peripheral surface of the housing, an antenna member having two shafts extended from a casing, a gear disposed on each of the shafts and movably engaged in the peripheral depression defined between the peripheral rib and the inner peripheral surface of the housing for guiding the casing of the antenna member to rotate relative the housing. A cap may rotatably secure the casing to the housing, to allow the casing to be rotated relative to the housing with the shafts or by a movement of the gears of the shafts in the peripheral depression of the housing.

11 Claims, 6 Drawing Sheets

ANTENNA DEVICE HAVING PIVOTAL DEVICE

BACKGROUND OF THE INVENTION

1. Field of the Invention

The present invention relates to an antenna device, and more particularly to an antenna device having a pivotal device for pivotally attaching or coupling an antenna member to a base housing member and for allowing the antenna device to be rotated or pivoted relative to the base housing member to various angular positions.

2. Description of the Prior Art

Typical antenna devices comprise an antenna member engaged in an outer housing which may be rotatably or pivotally attached or coupled to various base housing members or electric or radio facilities, such as portable or mobile phones, motor vehicles, global positioning systems, computer facilities, radio apparatuses or communications, etc.

For example, U.S. Pat. No. 6,023,218 to Tremblay discloses one of the typical locating and alarm systems or antenna devices comprising an antenna member or locating and alarm means extended from a base housing for attaching or coupling to a motor vehicle, and a radio frequency receiver electrically coupled to a circuit board for transmitting or receiving signals. However, the antenna member may not be suitably rotated and positioned to the outer housing at any selected angular positions.

U.S. Pat. No. 6,023,245 to Gomez et al. discloses another typical multi-band, multiple purpose antenna comprising an antenna member disposed or received within a base housing for transmitting or receiving signals. However, the antenna member may not be suitably rotated and positioned to the outer housing at any selected angular positions.

The present invention has arisen to mitigate and/or obviate the afore-described disadvantages of the conventional antenna devices for various electric or radio facilities.

SUMMARY OF THE INVENTION

The primary objective of the present invention is to provide an antenna device including a pivotal device for pivotally attaching or coupling an antenna member to a base housing member and for allowing the antenna device to be rotated or pivoted relative to the base housing member to various angular positions.

In accordance with one aspect of the invention, there is provided an antenna device comprising a housing including an orifice formed therein, a peripheral depression formed and located around the orifice and defined by an inner peripheral surface, and a peripheral rib extended in the peripheral depression of the housing and located around the orifice of the housing for forming the peripheral depression between the peripheral rib and the inner peripheral surface of the housing, an antenna member including a casing having two shafts, and a gear provided on each of the shafts and movably engaged in the peripheral depression defined between the peripheral rib and the inner peripheral surface of the housing for guiding the casing of the antenna member to rotate relative the housing, and a securing device for rotatably securing the casing of the antenna member to the housing, to allow the casing to be rotated relative to the housing with the shafts and to allow the casing to be rotated relative to the housing by a movement of the gears of the shafts in the peripheral depression defined between the peripheral rib and the inner peripheral surface of the housing.

The securing device includes a cap having an axle rotatably engaged into the orifice of the housing for guiding the casing to rotate relative the housing. The cap includes two apertures formed therein for receiving the shafts of the antenna member.

The cap includes at least one catch extended therefrom for engaging with the gears of the shafts and for anchoring the casing to the housing at selected angular position by an engagement between the catch of the cap and the gears of the shafts when the casing is rotated relative the housing with the shafts.

The housing includes at least one projection extended therefrom, and the cap includes a number of indentations or protrusions formed in an outer portion for engaging with the projection of the housing and for anchoring the casing to the housing at selected angular position by an engagement between the indentations or the protrusions of the cap and the projection of the housing when the casing is rotated relative the housing with the axle of the cap.

The shafts of the casing are tubular shafts each having a bore formed therein for receiving electric wires or cables. The casing includes an opening having the shafts extended into the opening of the casing.

The casing includes at least one cavity formed therein, and the housing includes at least one peg extended therefrom for engaging with the cavity of the casing and for anchoring the casing of the antenna member to the housing at selected angular positions.

The housing includes a recess formed in an upper portion and defined by a peripheral wall member for receiving and anchoring the casing of the antenna member. The housing includes a number of air perforations formed in the upper portion and communicating with the recess for air circulating and heat dissipating purposes.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
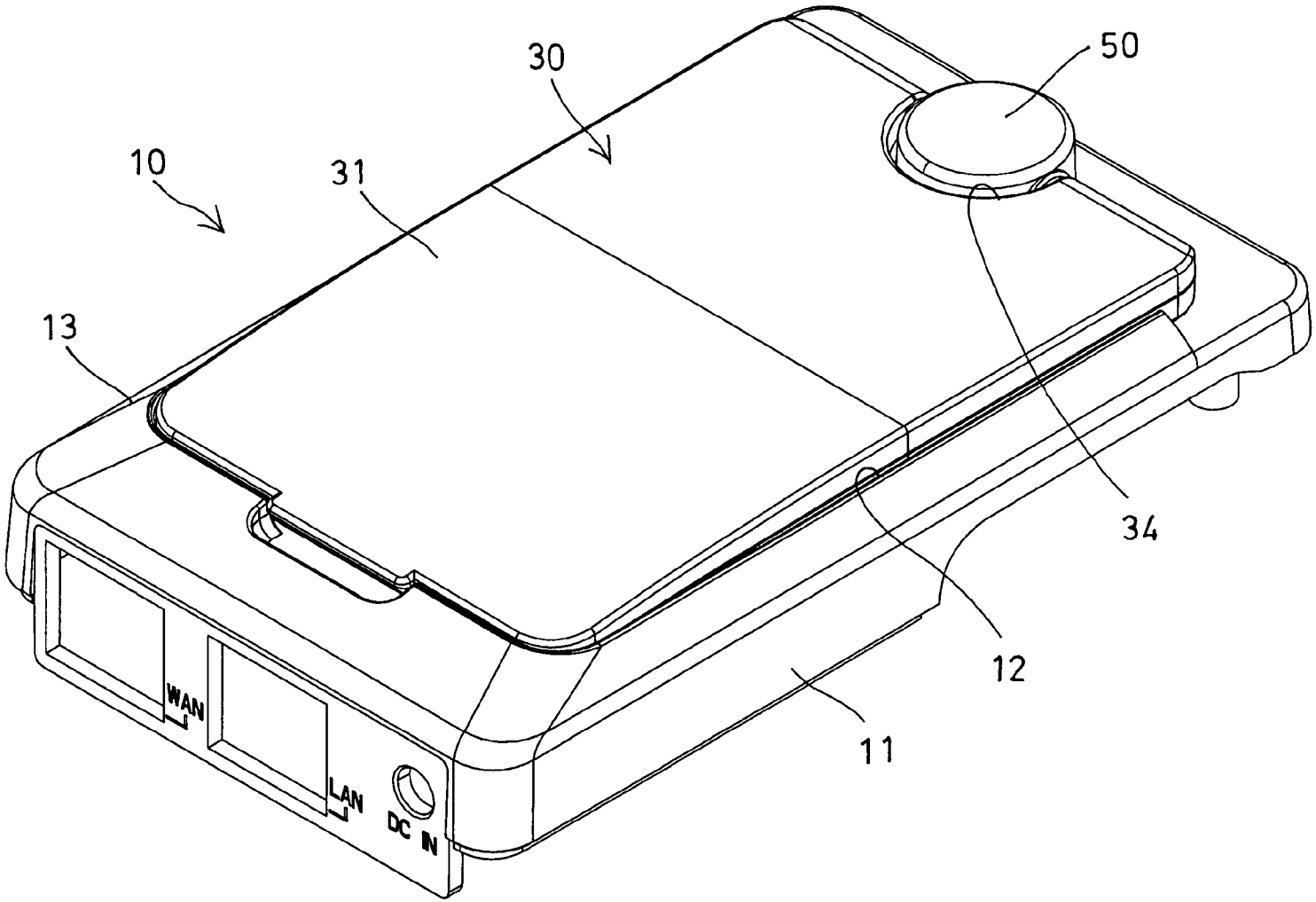
FIG. 1 is a perspective view of an antenna device in accordance with the present invention.
Figure 2:
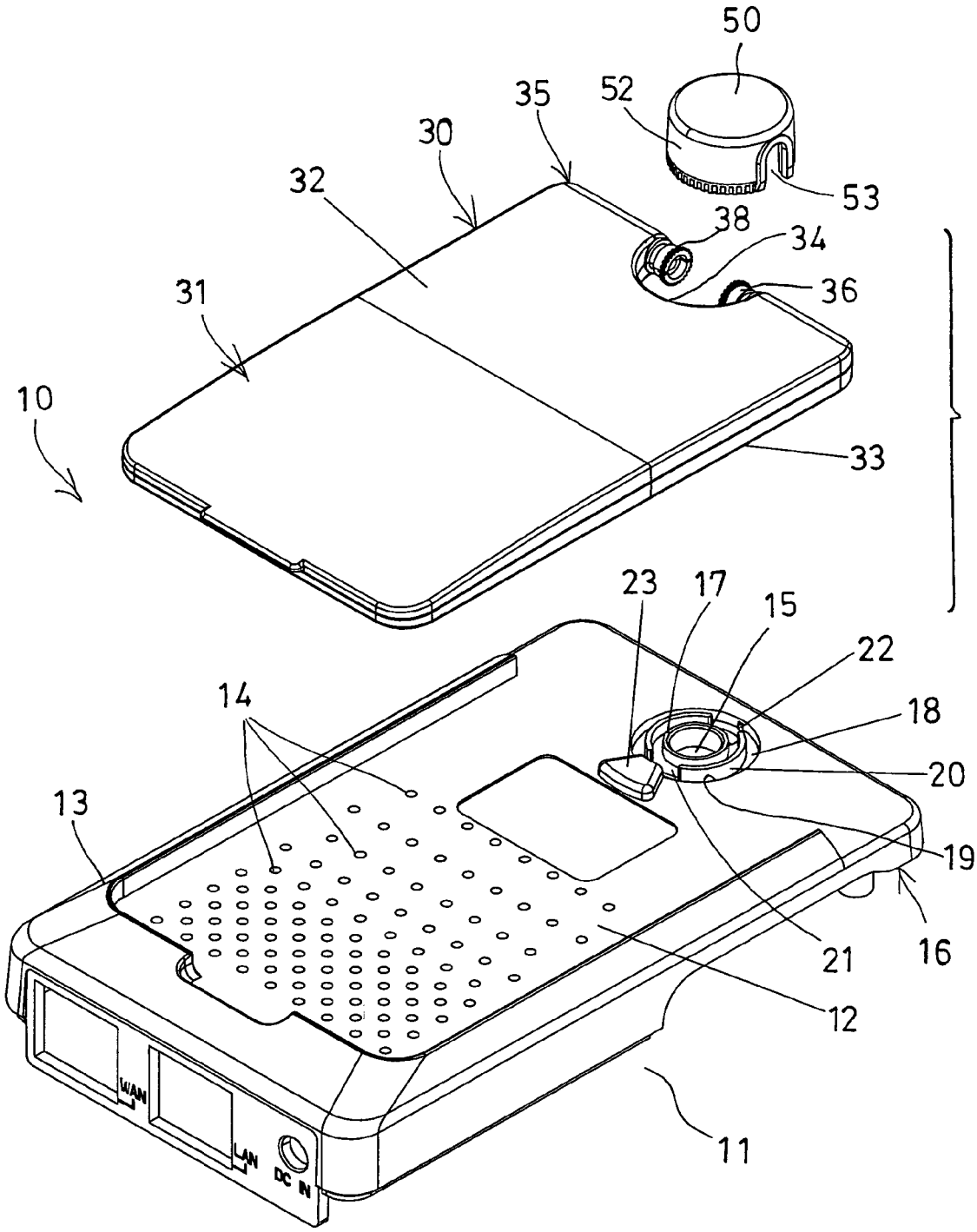
FIG. 2 is a partial exploded view of the antenna device.

Referring to the drawings, and initially to FIGS. 1 and 2, an antenna device 10 in accordance with the present invention comprises a base housing 11 including a recess 12 formed or provided in the upper portion thereof and defined by a peripheral or annular wall member 13, and including a number of air perforations 14 also formed or provided in the upper portion thereof and communicating with the recess 12 thereof for air circulating and/or heat dissipating purposes.

As shown in FIG. 2, the base housing 11 further includes an orifice 15 formed or provided in one end portion 16 thereof and defined by a peripheral fence or hub 17, and includes an annular or peripheral depression 18 formed or provided in the one end portion 16 thereof and formed or located around the orifice 15 or the hub 17 and defined by an inner peripheral surface 19, and further includes an annular or peripheral rib 20 extended upwardly in the annular or peripheral depression 18 of the base housing 11 and also located around the hub 17.

The annular or peripheral rib 20 may include one or more cut off portions or notches 21 formed therein. The base housing 11 further includes one or more projections 22 extended into the peripheral depression 18 of the base housing 11 and/or extended from the inner peripheral surface 19 of the base housing 11, and further includes one or more pegs 23 extended into the recess 12 of the base housing 11 and located around or beside the peripheral depression 18 of the base housing 11 or separated from the peripheral depression 18 of the base housing 11.

Figure 3:
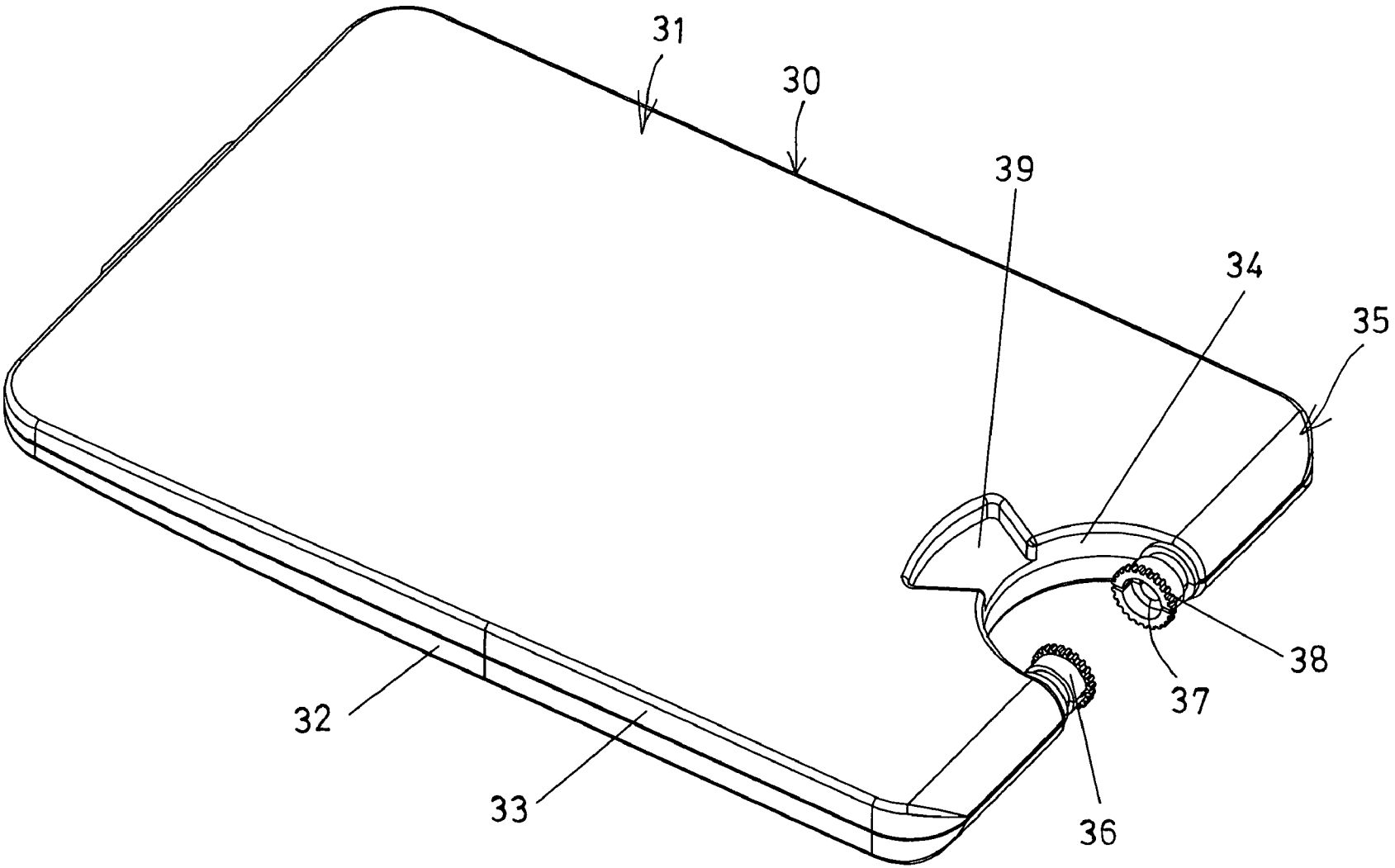
FIG. 3 is a perspective view of an antenna member of the antenna device.

The antenna device 10 further includes an antenna member 30 having an outer casing 31 formed or defined by such as two casing members 32, 33 for receiving a typical antenna element therein (not shown), the outer casing 31 of the antenna member 30 includes an opening 34 formed or provided in one end portion 35 thereof, and includes one or more, such as two tubular shafts 36 extended into the opening 34 of the outer casing 31, and the shafts 36 each includes a bore 37 formed therein (FIG. 3) for receiving electric wires or cables therein (not shown).

Figure 6:
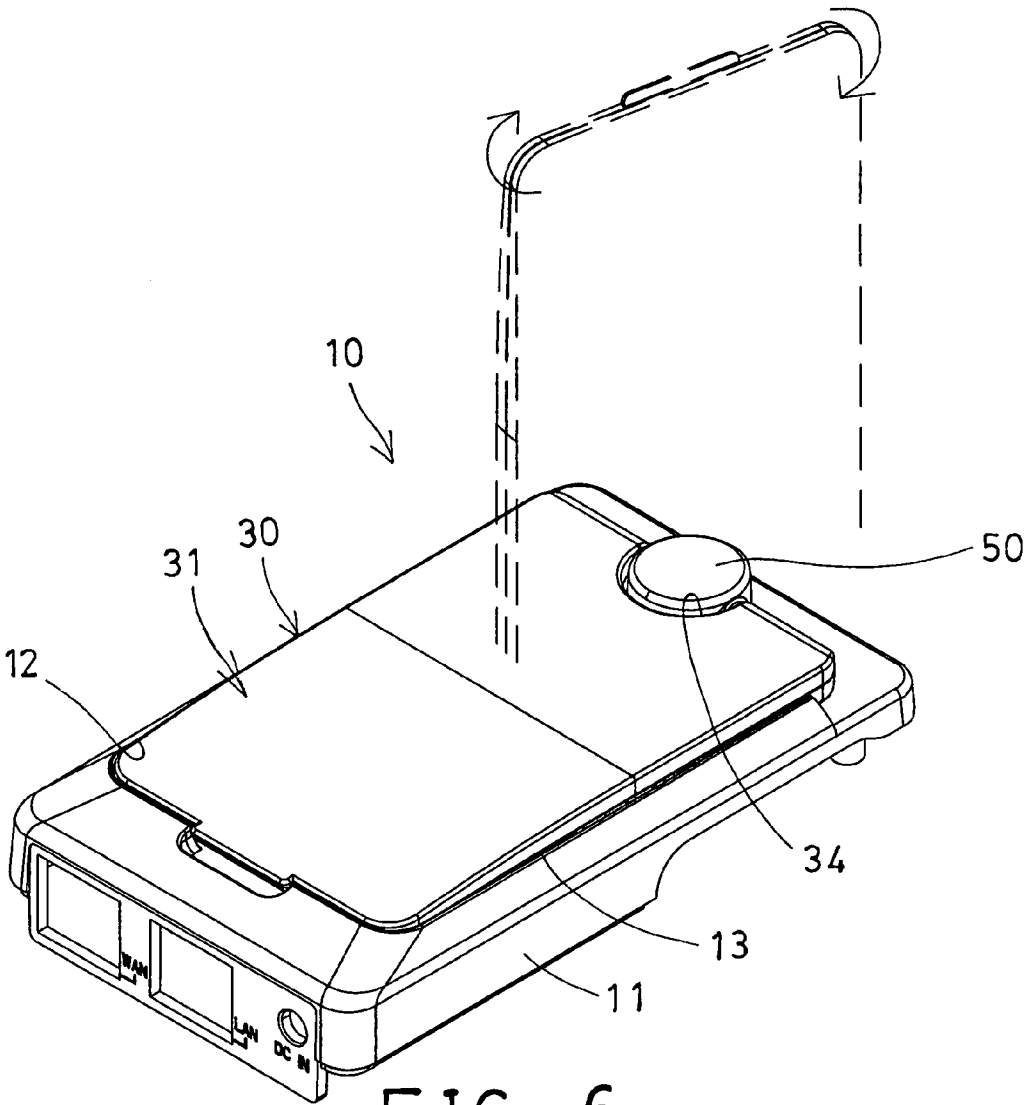

The outer casing 31 of the antenna member 30 further includes a gear 38 provided or extended radially and outwardly from an inner free end portion of each of the shafts 37 and movably engaged in the peripheral depression 18 defined between the peripheral rib 20 and the inner peripheral surface 19 of the base housing 11, for guiding the outer casing 31 of the antenna member 30 to rotate relative the base housing 11 (FIG. 6). The casing 31 of the antenna member 30 further includes one or more cavities 39 formed in the bottom portion thereof (FIG. 3) for receiving the pegs 23 of the base housing 11 and for anchoring or positioning the casing 31 of the antenna member 30 to the base housing 11 at any selected angular positions.

Figure 4:
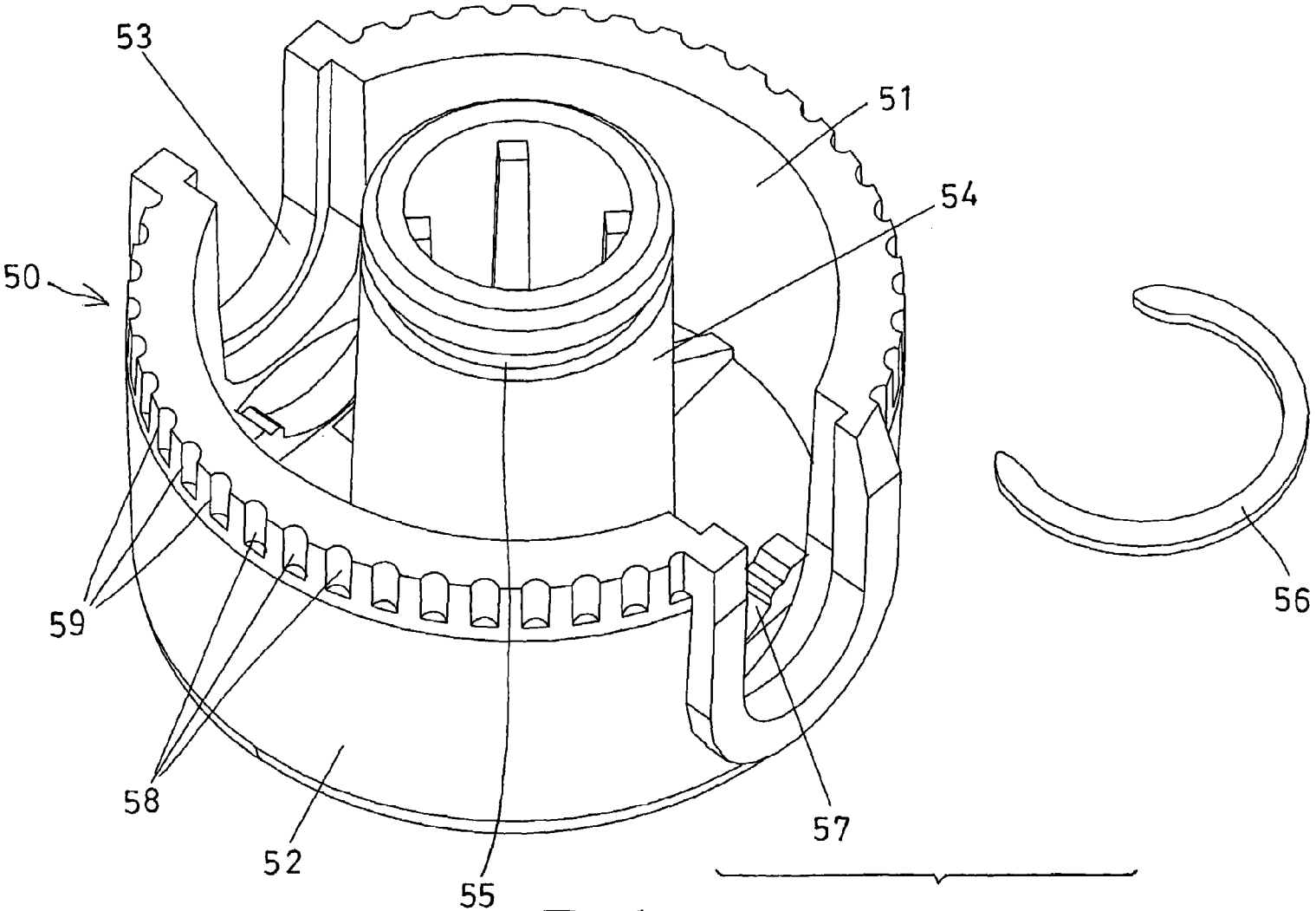
FIG. 4 is a further partial exploded view of the antenna device.
Figure 5:
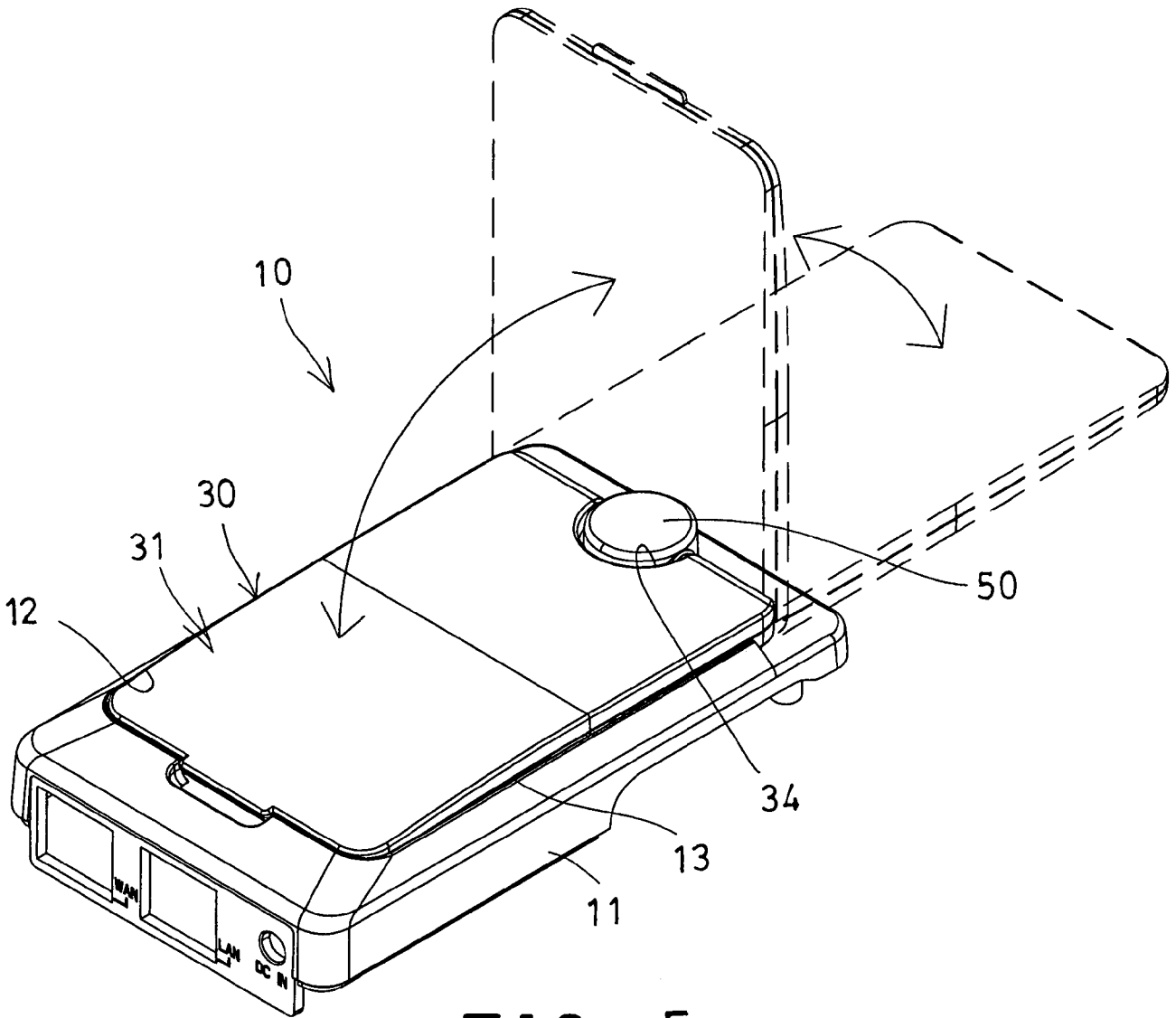
FIGS. 5, 6 are perspective views similar to FIG. 1, illustrating the operation of the antenna device.

As shown in FIG. 4, a cap 50 includes a chamber 51 formed therein and defined by an outer peripheral wall member 52, and includes one or more, such as two apertures 53 formed therein for receiving the tubular shafts 36 of the antenna member 30 and for allowing the cap 50 to be engaged into the opening 34 of the casing 31, and for rotatably attaching or coupling the casing 31 to the base housing 11 with the shafts 36 and the cap 50, and thus for allowing the casing 31 to be rotated relative the base housing 11 around the shafts 36 (FIG. 5).

The cap 50 includes an axle 54 extended into the chamber 51 thereof and rotatably engaged into the orifice 15 of the base housing 11 for further stably guiding the casing 31 of the antenna member 30 to rotate relative the base housing 11, and includes an annular groove 55 formed in the axle 54 for receiving a clamping or retaining ring 56 which may be engaged with the base housing 11 to stably couple or secure the cap 50 and thus the casing 31 of the antenna member 30 to the base housing 11, and for preventing the casing 31 from being disengaged from the base housing 11. The cap 50 may thus be used or acted as a securing means or device for rotatably securing the casing 31 of the antenna member 30 to the housing 11.

The cap 50 includes one or more, such as two catches 57 extended into the chamber 51 thereof and disposed or located beside the apertures 53 thereof for engaging with the gears 38 of the shafts 36 of the casing 31 and for anchoring or positioning the casing 31 of the antenna member 30 to the base housing 11 at any selected angular position by the engagement between the catches 57 of the cap 50 and the gear 38 of the shafts 36 of casing 31, when the casing 31 is rotated relative the base housing 11 around or about or with the shafts 36 (FIG. 5).

As shown in FIG. 4, the cap 50 further includes a number of indentations 58 or a number of protrusions 59 formed or provided on the outer peripheral portion thereof for engaging with the projections 22 of the housing 11 and for further anchoring or positioning the casing 31 of the antenna member 30 to the housing 11 at any selected angular position by the engagement between the indentations 58 or the protrusions 59 of the cap 50 and the projections 22 of the housing 11, when the casing 31 is rotated relative the housing 11 around or about or with the axle 54 of the cap 50 and/or the hub 17 of the housing 11 (FIG. 6), or when the gears 38 of the shafts 36 of casing 31 are rotatably or movably engaged in the peripheral depression 18 defined between the peripheral rib 20 and the inner peripheral surface 19 of the base housing 11.

In operation, as shown in FIG. 5, the casing 31 is rotatable relative the housing 11 around or about or with the shafts 36 from an inwardly folding or receiving position where the casing 31 of the antenna member 30 is received in the recess 12 of the housing 11, toward an upwardly extending position and a horizontally and outwardly extended working position as shown in dotted lines in FIG. 5, and the engagement between the catches 57 of the cap 50 and the gear 38 of the shafts 36 of casing 31 may anchor or position the casing 31 of the antenna member 30 to the housing 11 at any selected angular position.

When the casing 31 of the antenna member 30 is received in the recess 12 of the housing 11, the pegs 23 of the housing 11 may be engaged into the cavities 39 of the casing 31 of the antenna member 30 for anchoring or positioning the casing 31 of the antenna member 30 to the housing 11 at the inwardly folding or receiving position as shown in solid lines in FIG. 5 and for preventing the casing 31 of the antenna member 30 to from being rotated relative to the housing 11.

As shown in FIG. 6, when the casing 31 is rotated relative the housing 11 and disengaged from the recess 12 of the housing 11, the casing 31 may be rotated relative the housing 11 around or about or with the axle 54 of the cap 50 and/or the hub 17 of the housing 11, and the gears 38 of the shafts 36 of casing 31 may also be rotated or moved along the peripheral depression 18 defined between the peripheral rib 20 and the inner peripheral surface 19 of the base housing 11, for allowing the antenna member 30 to be rotated or pivoted relative to the housing 11 in a direction perpendicular to the rotational movement as shown in FIG. 5.

Accordingly, the antenna device in accordance with the present invention includes a pivotal device for pivotally attaching or coupling an antenna member to a base housing member and for allowing the antenna device to be rotated or pivoted relative to the base housing member to various angular positions.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. An antenna device comprising:

a housing including an orifice formed therein, a peripheral depression formed and located around said orifice and defined by an inner peripheral surface, and a peripheral rib extended in said peripheral depression of said housing and located around said orifice of said housing for forming said peripheral depression between said peripheral rib and said inner peripheral surface of said housing, an antenna member including a casing having two shafts, and a gear provided on each of said shafts and movably engaged in said peripheral depression defined between said peripheral rib and said inner peripheral surface of said housing for guiding said casing of said antenna member to rotate relative said housing, and means for rotatably securing said casing of said antenna member to said housing, to allow said casing to be rotated relative to said housing with said shafts and to allow said casing to be rotated relative to said housing by a movement of said gears of said shafts in said peripheral depression defined between said peripheral rib and said inner peripheral surface of said housing.

2. The antenna device as claimed in claim 1, wherein said securing means includes a cap having an axle rotatably engaged into said orifice of said housing for guiding said casing to rotate relative said housing.

3. The antenna device as claimed in claim 2, wherein said cap includes at least one catch extended therefrom for engaging with said gears of said shafts and for anchoring said casing to said housing at selected angular position by an engagement between said at least one catch of said cap and said gears of said shafts when said casing is rotated relative said housing with said shafts.

4. The antenna device as claimed in claim 2, wherein said cap includes two apertures formed therein for receiving said shafts of said antenna member.

5. The antenna device as claimed in claim 2, wherein said housing includes at least one projection extended therefrom, and said cap includes a plurality of indentations formed in an outer portion for engaging with said at least one projection of said housing and for anchoring the casing to the housing at selected angular position by an engagement between the indentation of the cap and the at least one projection of the housing when the casing is rotated relative the housing with the axle of the cap.

6. The antenna device as claimed in claim 2, wherein said housing includes at least one projection extended therefrom, and said cap includes a plurality of protrusions formed in an outer portion for engaging with said at least one projection of said housing and for anchoring the casing to the housing at selected angular position by an engagement between the protrusions of the cap and the at least one projection of the housing when the casing is rotated relative the housing with the axle of the cap.

7. The antenna device as claimed in claim 1, wherein said shafts of said casing are tubular shafts each having a bore formed therein for receiving electric wires or cables.

8. The antenna device as claimed in claim 1, wherein said casing includes an opening having said shafts extended into said opening of said casing.

9. The antenna device as claimed in claim 1, wherein said casing includes at least one cavity formed therein, and said housing includes at least one peg extended therefrom for engaging with said at least one cavity of said casing and for anchoring said casing of said antenna member to said housing at selected angular positions.

10. The antenna device as claimed in claim 9, wherein said housing includes a recess formed in an upper portion and defined by a peripheral wall member for receiving and anchoring said casing of said antenna member.

11. The antenna device as claimed in claim 10, wherein said housing includes a plurality of air perforations formed in said upper portion and communicating with said recess for air circulating and heat dissipating purposes.

* * * * *